United States Patent [19]

Elsel et al.

[11] 3,996,545

[45] Dec. 7, 1976

[54] HOLDING ARRANGEMENT FOR A LOW-TEMPERATURE-COOLED ELECTRIC WINDING WITHIN A VACUUM TANK

[75] Inventors: Werner Elsel, Erlangen; Franz Böhm, Grossgrundlach, both of Germany

[73] Assignee: Siemens Aktiengesellschaft, Munich, Germany

[22] Filed: Sept. 26, 1975

[21] Appl. No.: 617,171

[30] Foreign Application Priority Data

Sept. 30, 1974 Germany ..... 2446716

[52] U.S. Cl. ..... 336/92; 335/216; 336/197; 336/DIG. 1

[51] Int. Cl.[2] ..... H01F 27/02

[58] Field of Search ..... 336/DIG. 1, 90, 92, 336/197; 174/15 CA; 335/216

[56] References Cited

UNITED STATES PATENTS

| | | | |
|---|---|---|---|
| 389,353 | 6/1968 | Kafka et al. | 336/DIG. 1 X |
| 3,008,044 | 11/1961 | Buchhold | 335/216 X |

*Primary Examiner*—Thomas J. Kozma
*Attorney, Agent, or Firm*—Kenyon & Kenyon Reilly Carr & Chapin

[57] ABSTRACT

A holding arrangement is disclosed which can be employed to hold a winding enclosure which contains a low-temperature-cooled electric winding on which alternating external forces act, and which is fastened within a vacuum tank by means of tie rods. In particular, the arrangement includes pre-tensioned tie rods which are arranged to unilaterally pull, via pressure posts, with force-transmitting contact the winding enclosure against the inside walls of the vacuum tank. More specifically, the tensioning force at room temperature is selected such that at low termperature a residual tension force remains which is always at least as large as the component of the external force opposing it. With such a design for the holding arrangement no readjustment devices are necessary and the heat conduction effected thereby is relatively minor.

5 Claims, 3 Drawing Figures

HOLDING ARRANGEMENT FOR A LOW-TEMPERATURE-COOLED ELECTRIC WINDING WITHIN A VACUUM TANK

BACKGROUND OF THE INVENTION

1. Field of the Invention

The invention concerns a holding arrangement for a winding enclosure which is subject to external forces and is fastened within a vacuum tank by means of tie rods, and in which an electric winding cooled to a low temperature is arranged.

2. Description of the Prior Art

Electric windings, particularly superconducting windings, which are cooled to a low temperature by means of a cryogenic medium, must generally be heat-insulated against their environment. They are, therefore, arranged in a winding enclosure and are, advantageously, surrounded by a vacuum within a vacuum tank. Additionally, reflecting wrinkled foil, so-called superinsulation, may also be provided between the winding enclosure and the vacuum tank for reducing the heat influx into the cooled winding. Such heat insulation, however, can transmit only very small forces in the transversal direction. For this reason, additional holding means for the enclosure are usually provided so that the excited winding maintains its position within the vacuum tank under the action of external forces. Such forces can occur between the winding and the vacuum tank if for example, several windings are excited asymmetrically or if a winding is rotated.

In German Patent No. 1,514,633, a holding device for a thermally insulated and superconducting winding is taught in which the device is arranged inside the winding enclosure. The winding enclosure, in turn, is held within an outer housing by tie rods. Each tie rod is provided with an elastic intermediate member whose spring excursion is chosen so that upon cooling the superconducting winding from room temperature to a temperature near absolute zero, the length and position changes of the tie rods due to thermal effects are substantially compensated for without stressing the tie rods. Moreover, by limiting the spring excursion of the elastic intermediate member, which may, for example, be a cup spring, the effect of the intermediate member can be substantially eliminated at the low temperature required to bring about superconduction. The forces acting on the winding are then transmitted only by the tie rods.

For limiting the spring excursion of the elastic intermediate member of the above device, an adjusting device situated outside the outer housing is required. If this outer housing is to serve as the vacuum housing, the required feedthroughs for the adjusting device must be designed so as to be vacuum-tight. The design of such feedthroughs is, therefore, quite expensive. In addition, the feedthroughs are required to have a relatively large cross section, so that, in general, they result in heat conduction losses which must be compensated for by providing special cooling for the superconducting winding.

It is an object of the present invention to simplify and improve the aforesaid holding arrangement. In particular, it is an object of the present invention to modify such arrangement so that the winding enclosure is safely and firmly secured at all temperatures and under the action of alternating external forces, without the need for additional adjusting devices and in a manner which minimizes the heat influx into the winding.

SUMMARY OF THE INVENTION

In accordance with the principles of the present invention, the above and other objectives are realized in a holding arrangement of the above-type by providing that each tie rod be pre-tensioned at room temperature with a predetermined tension force which pulls the winding housing unilaterally, via pressure posts, with force-transmitting contact, against the inside wall of the vacuum tank. More particularly, the tension force at room temperature is selected in such a manner that the aforesaid force-transmitting contact between the vacuum tank, the pressure posts and the winding enclosure is maintained at low temperature, due to a residual tension force which is always at least as large as the component of the external forces opposing it.

With the holding arrangement so designed, the tie rods are required to be pretensioned only once at room temperature with a predetermined tension force for a given external load on the rods. Thus, in the cooled-down condition, retensioning of the holding device or readjustment of the winding enclosure within the vacuum tank is no longer necessary. Similarly, the once provided pretension is retained in case the winding in the winding enclosure again warms up, e.g., after a disturbance or if the winding is no longer in operation.

In the embodiment of the holding arrangement to be described hereinafter, the pre-tensioning force at room temperature is selected such that it is at least equal to the maximum force component of the external force which acts in the pull direction of the tie rods and engages the winding housing at low temperature. This prevents the tie rods from being overdesigned and causes them to produce a relatively negligible heat influx into the winding enclosure at low temperature.

BRIEF DESCRIPTION OF THE DRAWING

The above and other aspects and features of the present invention will become more apparent upon reading the following detailed description viewed in conjunction with the accompanying drawings, in which.

DETAILED DESCRIPTION

Figure 1:
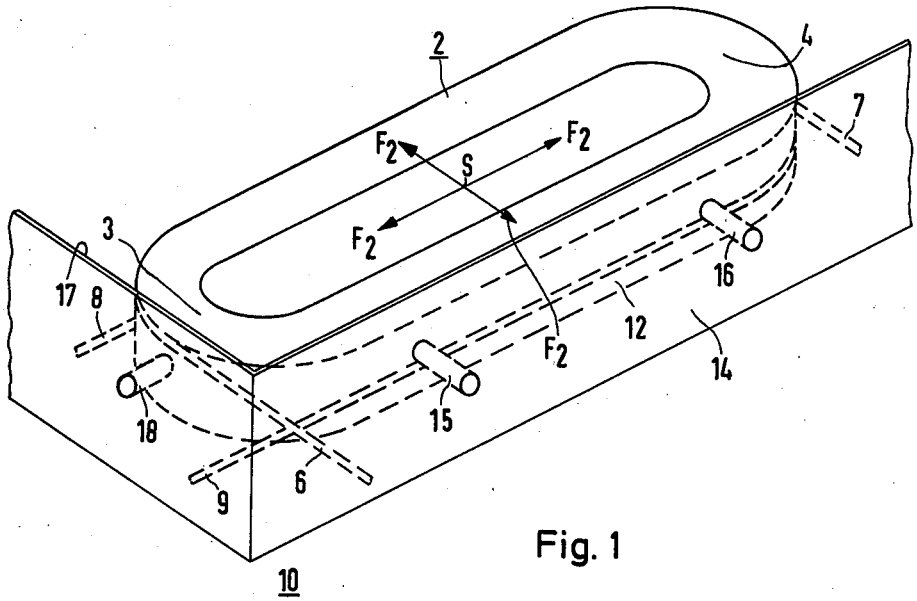
FIG. 1 is an oblique view of a holding arrangement according to the principle of the present invention.

In FIG. 1, a flat, elongated winding enclosure 2 of a rectangular magnet is shown. The latter magnet may, serve, for example, as a lift or lateral-guidance magnet in a magnetic levitation system of a type in which contact-less guidance of a vehicle along a stationary track in accordance with the electrodynamic repulsion principles occurs. The winding enclosure 2, which is rounded at its end faces 3 and 4, serves as a support structure for a winding (not shown in detail in the figure) which is fixedly arranged in the enclosure. The enclosure also serves at the same time as a cryostat for the conductors of the winding which comprise, for example, superconductive material and are cooled with liquid helium at a low temperature close to absolute zero.

As can be seen, the winding enclosure 2 is held unilaterally by two pre-tensioned tie rod pairs 6, 7 and 8, 9, respectively, in a vacuum tank 10 which is only partly illustrated in the figure and which is at room temperature. The winding enclosure 2 is thus pulled by the pre-tensioned tie rods 6 and 7, so that its long side 12 moves against one inside wall 14 of the vacuum tank 10. As shown, the two tie rods 6 and 7 are formed from the two ends of a common tension strap which is placed around the long side of the enclosure opposite the side 12 and extends halfway about the two end faces 3 and 4. In order to prevent the side 12 of winding enclosure 2 from resting directly against the vacuum tank 10, two pressure posts 15 and 16 are provided and are arranged between the winding enclosure and the vacuum tank with positive force transmission in the pull direction of the two tie rods 6 and 7.

Similarly, the winding enclosure 2 is also pulled by the other pair of tie rods 8 and 9, whose direction of pull is rotated 90° relative to the pull direction of tie rods 6 and 7, in the direction toward an inside wall 17 of the vacuum tank 10 and is kept at a predetermined spacing from this inside wall by a pressure post 18.

The pressure posts 15, 16 and 18 may, advantageously, each comprise a poorly heat-conducting material, e.g., a plastic material which is reinforced with glass fibers. As a result, the influx of heat from the vacuum tank 10 which is at room temperature, to the deep-cooled winding inside the winding enclosure 2 is thereby limited. The tie rods 6 to 9 may, therefore, also advantageously comprise a poorly heat-conducting material which is additionally possessed of an appropriate breaking strength. In particular, strips or wires of chrome-nickel steel may be used for the tie rods.

Also indicated in FIG. 1, by appropriately designated arrows are the forces acting on the magnet winding and, therefore, on the winding enclosure 2 at their common center of gravity S. These forces are represented by pairs of components in the longitudinal and transversal directions of the winding enclosure 2 and are each designated as $F_2$. Such forces additionally include forces which act on the magnet winding from the outside such as, for example, the alternating lateral forces which act on a lift magnet in an electrodynamic suspension guidance system or velocity-dependent braking forces. As can be seen, the two pull directions of the pairs of tie rods 6, 7 and 8, 9 lie advantageously, at least approximately, in the direction of the maximal components of these forces acting on the center of gravity. In the figure it is assumed that these components occur in the longitudinal and the transversal directions of the winding enclosure.

The tie rods 6 to 9 must be pre-tensioned sufficiently at room temperature, as well as at the operating temperature, so that positive force transmission is maintained between the enclosure 2 and the walls 14 and 17, via the pressure posts 15, 16 and 18, in the case of alternating external forces. Moreover, to limit the heat transfer to the winding, it is advantageous to keep the cross section of the tie rods 6 to 9 as small as possible. Also, in selecting the tension provided by the rods, the maximally permissible load on the pressure posts must be taken into consideration.

Figure 2:
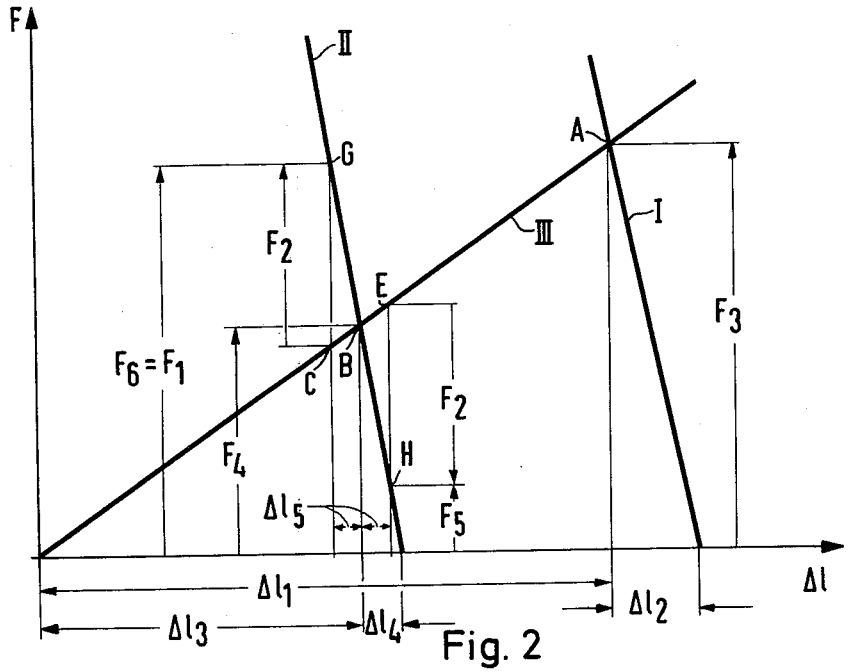
FIG. 2 shows a diagramatic graphic technique for determining the force by which the tie rods of the holding arrangement of FIG. 1 are to be pre-tensioned.

An example of a method of graphic solution which takes into account the above considerations and which realizes an advantageous design of the holding arrangement of FIG. 1 is illustrated in FIG. 2. The solution in FIG. 2 assumes a holding arrangement comprising one or several pressure posts, on which a force in the pull direction is exerted by pre-tensioning at one or several tie rods. Additionally, also assumed is an alternating external force which acts on the winding enclosure in the pull direction or in the direction opposite thereto. This latter force may, for example, be the aforementioned braking force acting on the magnet winding in a magnetic suspension system.

As can be seen in FIG. 2, plotted on the ordinate axis are the forces F acting on the holding arrangement and on the abscissa axis the length changes $\Delta$ l occurring in a respective pressure post and tie rod of the arrangement caused by these forces.

For a given operating condition at low temperature, a maximum permissible load designated as $F_1$ is assumed to be able to be applied to the pressure post. This maximum load is understood to be a force of magnitude $F_1$ in the given pull direction which the pressure post can take up or withstand without difficulty. In addition, an alternating external force is assumed whose maximum component in the pull direction or opposite thereto has a magnitude designated as $F_2$.

With the diagram of FIG. 2, the pressure post of the holding arrangement can thus be designed in a known manner taking into consideration the maximum force $F_1$ which can act on it and, at the same time the minimum heat conduction condition which is to be met. In particular, the latter two parameters, establish the slopes of the force-vs-elongation curves I and II of the post at room and low temperatures, respectively. As can be seen, the slope of the force-vs-elongation curve II is in general somewhat steeper than the slope of Curve I.

The tie rod of the holding arrangement, with which a predetermined force-vs-elongation curve III is associated, is assumed to be pre-tensioned at room temperature by a pre-tensioning force $F_3$. At this temperature, a point A is thereby fixed on the force-vs-elongation curve III of the tie rod. The point A, in turn, fixes the abscissa intercept position of force-vs-elongation curve I of the pressure post at room temperature, the latter curve being moved until it intersects the point A. The tie rod is thus elongated at room temperature by the length $\Delta l_1$, under the action of the pre-tensioning force $F_3$. At the same time, the pressure post at room temperature is shortened by the length $\Delta l_2$. This length change is obtained from the projection of the force-vs-elongation curve I between its abscissa intercept and the point A onto the abscissa axis. As can be appreciated, the length $\Delta l_2$ is a measure of the compression of the pressure post.

If the magnet winding is cooled down from room temperature, e.g., to the temperature of the liquid helium, the pretension force in the tie rod and in the pressure post is now reduced from $F_3$ to a value $F_4$. With this residual pre-tension $F_4$, the elongation of the strip of the tie rod is now reduced to a value $\Delta l_3$. Thus, an operating point B is established on the force-vs-elongation curve III of the tie rod, which point fixes the position of the low temperature force-vs-elongation curve II of the pressure post in a similar manner as the point A fixed the position of curve I. The compression of the pressure post is hence reduced to a value $\Delta l_4$.

If now the alternating force in the pull direction or in the corresponding opposite direction with the maximum magnitude $F_2$ acts on the magnet winding or the winding enclosure, the length of the tie rod is changed by an amount $\pm\Delta l_5$. Depending on the direction of the force $F_2$, the operating point B on the force-vs-elongation curve III of the tie rod then shifts to the point C or E. At the same time, however, the additional force $F_2$ also acts on the pressure post, whose length changes accordingly, i.e., the corresponding operating point on the force-vs-elongation curve II becomes fixed for a force $F_2$ in the pull direction at the point G, or for a force $F_2$ in the direction opposite to the pull direction, at the point H. Thus, depending on the direction of the force $F_2$, a total force of magnitude $F_5$ or $F_6$ acts on the pressure post. The tie rod, on the other hand, is loaded with a force $F_5 + F_2$ (Point E) or with a force $F_6 - F_2$ (Point C).

As can be appreciated, the force $F_6$ acts maximally on the tie rod and the pressure post system. The pressure post must, therefore, be able to take up this force fully. In the present illustrative embodiment, it has been assumed that the force $F_6$ is equal to the force $F_1$ with which the pressure post can be maximally stressed. Such a design ensures that the pressure post is not overdesigned and results in the least heat conduction.

The slope of the force-vs-elongation curve III for the tie rod can be influenced by changing the tie rod cross section, the position of the point of attack of the tie rod at the winding enclosure and the tie rod material, e.g., by changing Young's modulus. The tie rod is advantageously designed so that the pretensioning force $F_3$ at room temperature (Point A) is not larger than the maximally occurring force $F_6$ (Point G) in the operating condition at low temperature. The heat conduction to the winding enclosure and the deep-cooled winding can, therefore, be kept particularly low, as in this case the tie rod is not overdesigned.

It the holding arrangement is designed in accordance with FIG. 2, the maximally permissible displacement of the magnet winding and its winding enclosure relative to the vacuum tank must also be taken into consideration. Such displacement may be required to be limited to a predetermined amount because of the relatively small flexibility of cryo and other connecting leads for the magnet winding inside the vacuum tank.

The pressure post of the holding arrangement of FIG. 1 may also advantageously be loaded with a minimum pressure $F_5$, even when the external force component $F_2$ is a maximum and pointing in the opposite direction. In such case, the winding enclosure is prevented from being lifted from the pressure post, which lifting would occur if the positive force transmission between the winding enclosure and the vacuum tank were broken.

Figure 3:
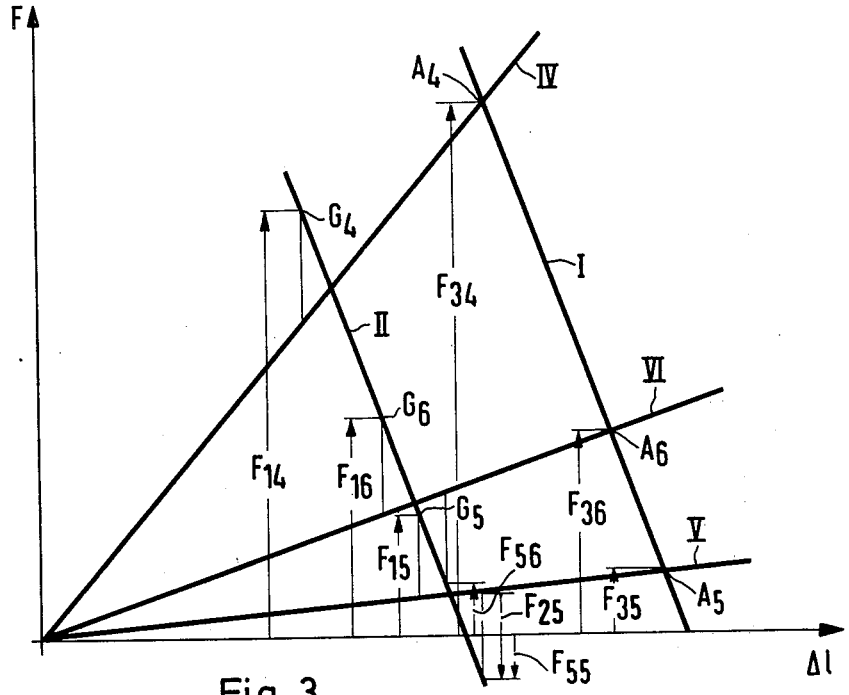
FIG. 3 shows another graphic technique useful in the design of the tie rods of FIG. 1.

The slope of the force-vs-elongation curve III required to achieve the above can be determined graphically for the tie rod of the holding arrangement by means of the diagram of FIG. 3 in which the force F are likewise plotted versus the elongation $\Delta l$. As in FIG. 2, FIG. 3 shows two force-vs-elongation curves I and II for a pressure post at room and low temperatures, respectively. Also, in FIG. 3 three force-vs-elongation curves IV to VI, analagous to curve III in FIG. 2, are shown for three different tie rods. The curves IV to VI go through the coordinate system origin and have different slopes. The points of intersection $A_4$ to $A_6$ of the curve I with the curves IV to VI as well as the points $G_4$ to $G_6$ on the force-vs-elongation curve II, which points result from the action of the alternating external force, are determined in accordance with the previous explanations made with respect to FIG. 2. The forces indicated in FIG. 3, moreover, correspond to the forces in FIG. 2, each force in FIG. 3 being provided with an additional subscript to indicate its association with the force-vs-elongation curve of a particular tie rod.

In FIG. 3, the force-vs-elongation curve IV has the steepest slope. As can be seen, the ordinate of the intersection point $A_4$ lying on it is larger than the ordinate of the ordinate of the operating point $G_4$ on the force-vs-elongation curve II of the pressure post, i.e., the pre-tensioning force $F_{34}$ at room temperature is larger than the maximally acting force F14 at operating temperature. The tie rod corresponding to curve IV is , therefore, overdesigned relative to the pressure post.

In the case of the force-vs-elongation curve V with the smallest slope, on the other hand, the point $G_5$ is higher than the point $A_5$, i.e., the pre-tensioning force $F_{35}$ is smaller than the maximally acting force $F_{15}$. In the case shown, a force $F_{55}$ results which becomes negative, i.e., the tie rod cannot hold the winding enclosure at the vacuum tank via the pressure post with positive force transmission in the case of an external force $F_{25}$ against the pull direction of the rod. The winding enclosure can, therefore, be lifted off the pressure post or the vacuum tank.

The aforesaid disadvantages of the tie rods corresponding to curves IV and V are avoided with the tie rod of the invention which is designed so as to result in the force-vs-elongation curve VI. In particular, the cross section, attack point at the winding enclosure and the material (Young's modulus) of the tie rod are selected in such a manner that the slope of curve VI results in a minimum heat influx from the vacuum tank to the winding enclosure. In particular, as can be seen curve VI is such that the maximally acting force $F_{16}$ is slightly larger than the pretensioning force $F_{36}$ i.e., the point $A_6$ has a somewhat smaller ordinate value than the point $G_6$. Moreover, the minimum force $F_{56}$ is always larger than zero.

The holding arrangement of the present invention can be advantageously used for applications other than for superconducting magnets of magnetic suspension railroads. More particularly, it can be used generally for any superconducting or low-temperature-cooled magnet windings on which additional external forces act. These forces may be caused amongst other things by iron shields, by adjacent magnets or other magnetic devices such as, for example, experimental apparatus.

What is claimed is:

1. A holding arrangement fastening a winding enclosure to a vacuum tank, said enclosure being subject to external forces and housing an electric field winding which is to be cooled to a low temperature, said arrangement comprising:

pressure posts arranged between the enclosure and said tank;

and tie rods unilaterally pulling said enclosure against said pressure posts, said rods being pre-tensioned by a force at room temperature to provide a positive force transmitting contact between said enclosure and said tank via said posts at room temperature, said pre-tensioning force being of such a magnitude that at low temperatures a residual force remains which is at least as large as the component of said external forces opposing it, whereby said positive force transmitting contact is maintained at said low temperature.

2. A holding arrangement in accordance with claim 1 in which said tie rods are arranged to engage said enclosure in such a manner that the directions in which pull is exerted thereby are at least approximately parallel to the directions of the largest components of said external forces.

3. A holding arrangement in accordance with claim 1 in which the largest force component of said external forces acting on the winding enclosure at low temperature in the direction of pull of said rods is at least as large as said pre-tensioning force.

4. A holding arrangement in accordance with claim 3 in which said posts have a load carrying capacity which is slightly larger than said largest force component.

5. A loading arrangement in accordance with claim 1 in which said tie rods comprise strips of a chrome-nickel steel material.

* * * * *